US008137015B2

(12) United States Patent
Noda

(10) Patent No.: US 8,137,015 B2
(45) Date of Patent: Mar. 20, 2012

(54) IMAGE FORMING METHOD FOR DETERMINING A POSITION OF AN INK RIBBON WITH A BOUNDARY LINE

(75) Inventor: Yutaka Noda, Sanda (JP)

(73) Assignee: Funai Electric Co., Ltd., Osaka (JP)

( * ) Notice: Subject to any disclaimer, the term of this patent is extended or adjusted under 35 U.S.C. 154(b) by 905 days.

(21) Appl. No.: 11/362,849

(22) Filed: Feb. 28, 2006

(65) Prior Publication Data

US 2006/0204307 A1 Sep. 14, 2006

(30) Foreign Application Priority Data

Feb. 28, 2005 (JP) ..... 2005-054068

(51) Int. Cl.
*B41J 33/00* (2006.01)

(52) U.S. Cl. ..... 400/223; 400/249; 347/213; 347/214; 347/215

(58) Field of Classification Search ..... 347/213, 347/214, 215; 400/223, 249
See application file for complete search history.

(56) References Cited

FOREIGN PATENT DOCUMENTS

| | | | |
|---|---|---|---|
| JP | 06015937 A | * | 1/1994 |
| JP | 6-32976 B2 | | 5/1994 |
| JP | 11-240219 A | | 9/1999 |
| JP | 11-334188 A | | 12/1999 |
| JP | 2002-160390 A | | 6/2002 |

OTHER PUBLICATIONS

Machine translation of JP 11-240219 (English).*
Notice of Reason for Refusal of corresponding Japanese Patent Application No. 2005-054068 dated May 10, 2010.

* cited by examiner

*Primary Examiner* — Matthew G Marini
(74) *Attorney, Agent, or Firm* — Global IP Counselors

(57) ABSTRACT

A method of forming an image on a transfer sheet based on electronic data uses an image forming device and an ink ribbon cartridge. An ink ribbon of the ink ribbon cartridge has a plurality of ink films formed thereon with boundary lines being provided between the ink films. In the image forming method, the ink ribbon of the ink ribbon cartridge is conveyed when the power to the image forming device is turned on and the ink ribbon cartridge is installed in the image forming device and before the user inputs the image forming instruction. While the ink ribbon of the ink ribbon cartridge is conveyed, it is determined with a boundary line detecting unit whether at least one of the boundary lines formed on the ink ribbon has reached a predetermined position in the image forming device.

5 Claims, 7 Drawing Sheets

| Type of ribbon cartridge | Status of switch 51a | Status of switch 51b |
|---|---|---|
| No cartridge | OFF | OFF |
| Cartridge for postcard size | ON | ON |
| Cartridge for L size | OFF | ON |
| Cartridge for card size | ON | OFF |

IMAGE FORMING METHOD FOR DETERMINING A POSITION OF AN INK RIBBON WITH A BOUNDARY LINE

BACKGROUND OF THE INVENTION

1. Field of the Invention

The present invention relates to an image forming device. More specifically, the present invention relates to thermal printer and image forming method that use an ink ribbon mechanism.

2. Background Information

In recent years, efforts are being made to develop image forming devices for printing print data (YMC data), which are obtained by converting and expanding image data (RGB data) from transmitted from a digital video camera. Since this kind of YMC data are structured as gradation data, it is preferable to use an image forming device that has high gradation reproducibility. Therefore, development of thermal transfer type image forming devices (thermal printers and the like) is being pursued because the gradation reproducibility of thermal transfer type image forming device is considered to be better than that of ink discharging-type image forming device.

With thermal transfer image forming devices (e.g., thermal printers), a large number of gradations can be obtained per pixel by controlling the amount of heat to be applied during printing. Thermal printers are normally provided with a thermal head (line head) having several thousand or more heating elements (dot heating elements) arranged in a row (arranged along the main scanning direction).

The thermal head is configured to transfer the dye (ink) of the ink ribbon to a transfer sheet (print sheet) by heating the ink ribbon. Since the amount of ink transferred to the print sheet varies depending on the amount of heat transferred by the thermal head, this variation is utilized to form an image having rich gradations on the print sheet.

A known image forming device is configured such that when a print driver receives a print instruction from a computer, a thermal printer application, or the like, the print driver sends a warm-up start instruction to a control unit (CPU) of the image forming device. Upon receiving the warm-up start instruction, the control unit sends a control signal to various components (e.g., the thermal head) of the image forming device and thereby starts the warm-up process. In other words, the aforementioned warm-up process is not started until after a print instruction is received from a user.

Consequently, the user is forced to wait for a period of time from when the user makes the print instruction until the printing actually starts. Furthermore, if an error occurs during the warm-up process due to, for example, the ink ribbon being expended, the time spent waiting after the user made the print instruction until the error is detected is wasted and the user may have to make the print instruction again.

In view of the above, it will be apparent to those skilled in the art from this disclosure that there exists a need for improved image forming method and image forming device that overcome the above-described problems. This invention addresses this need in the art as well as other needs, which will become apparent to those skilled in the art from this disclosure.

SUMMARY OF THE INVENTION

The object of the present invention is to provide an image forming method and image forming device which allows the waiting time of a user to be prior to the printing and which allows the user's printing operation to be simplified.

A method of forming an image on a transfer sheet based on electronic data in accordance with an aspect of the invention uses an image forming device and an ink ribbon cartridge, an ink ribbon of the ink ribbon cartridge having a plurality of ink films formed thereon with boundary lines being provided between the ink films. The method includes turning on power to the image forming device; installing the ink ribbon cartridge in the image forming device; a user inputting an image forming instruction; forming the image on the transfer sheet upon the image forming device receiving the image forming instruction; and conveying the ink ribbon of the ink ribbon cartridge while determining with a boundary line detecting unit whether at least one of the boundary lines formed on the ink ribbon has reached a predetermined position in the image forming device. The conveying of the ink ribbon and the determining is performed when the power to the image forming device is turned on and the ink ribbon cartridge is installed in the image forming device and before the user inputs the image forming instruction.

With this image forming method, when an ink ribbon cartridge is installed into, for example, a thermal printer (image forming device) or when the power to a thermal printer is turned on while an ink ribbon cartridge is already installed, the ink ribbon is fed to the next boundary line (such as a black marker, which indicates the lead position of an ink film) using a boundary line detecting unit such as a marker sensor and a drive unit such as a feed motor.

The image forming method preferably further includes stopping the conveyance of the ink ribbon when it is determined that a boundary line has reached the predetermined position before the user inputs the image forming instruction.

Also, with this image forming method, when a boundary line such as a black marker is determined to have reached the predetermined position, the CPU (control unit) stops the conveyance of the ink ribbon and waits for an image forming instruction (print instruction waiting mode). The waiting mode continues until an image forming instruction is received from a user.

The image forming method preferably further includes determining that the ink ribbon has been expended to its terminal end, when no boundary line is determined to have reached the predetermined position by the time the ink ribbon is conveyed by a prescribed distance; and notifying the user that the ink ribbon is expended, when it is determined that the ink ribbon has been expended to its terminal end.

Here, when a boundary line is not detected by the time the ink ribbon is conveyed by the prescribed distance, the CPU determines that the ink ribbon has been expended to the terminal end thereof (i.e., the ink ribbon has been used to the terminal end). Thus, the conveyance of the ink ribbon is stopped, and an ink ribbon terminal end processing (e.g., informing the user and discharging the print sheet) is executed.

Alternatively, in the image forming method, some of the boundary lines formed on the ink ribbon constituting print start positions. During the conveying of the ink ribbon of the ink ribbon cartridge, it is determined with a print start position detecting unit whether a print start position formed on the ink ribbon has reached a predetermined position in the image forming device, the conveying of the ink ribbon and the determining being performed when the power to the image forming device is turned on and the ink ribbon cartridge is installed in the image forming device and before the user inputs the image forming instruction. The image forming method further includes stopping the conveyance of the ink ribbon when it is determined that a print start position has reached the predetermined position before the user inputs the image forming instruction; determining that the ink ribbon has been expended to its terminal end when no print start position is determined to have reached the predetermined position by the time the ink ribbon is conveyed by a prescribed distance; and notifying a user that the ink ribbon is expended when it is determined that the ink ribbon has been expended to its terminal end.

With this image forming method, when an ink ribbon cartridge is installed into, for example, a thermal printer (image forming device) or when the power to a thermal printer is turned on while an ink ribbon cartridge is already installed, the ink ribbon is conveyed to a print start position (lead position of a yellow ink film, for example) using a marker sensor and a feed motor.

Also, with this image forming method, when a print start position is detected, the CPU shifts the thermal printer into a waiting mode (image forming instruction waiting mode). The waiting mode continues until an image forming instruction is received from a user.

Furthermore, with this image forming method, when a print start position is not detected by the time the ink ribbon is conveyed by the prescribed distance, the CPU determines that the ink ribbon has been expended to the terminal end thereof (i.e., the ink ribbon has been used to the terminal end), stops the feed of the ink ribbon, and executes ink ribbon terminal end processing (e.g., informing the user and discharging the print sheet).

With the present invention, the ink ribbon starts being conveyed and the determination of whether the boundary line has reached the predetermined position starts when an ink ribbon cartridge is installed by a user or when the power to the image forming device is turned on with an ink ribbon cartridge being already installed in the image forming device. As a result, the flow of control processing to be executed after an image forming instruction is received can be shortened. Thus, the waiting time of the user can be shortened.

Also, with the present invention, detection of expenditure of the ink ribbon and the associated error processing can be executed before an image forming instruction is received from the user. As a result, the user can be prevented from having to make another an image forming instruction after having made a first image forming instruction without knowing that the ink ribbon is expended and having had to wait for the error processing to finish.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Embodiments of an image forming method and an image forming device in accordance with the present invention will now be described with reference to the drawings.

First Embodiment

<1. Overview of the Constituent Features of the Thermal Printer>

Figure 2:
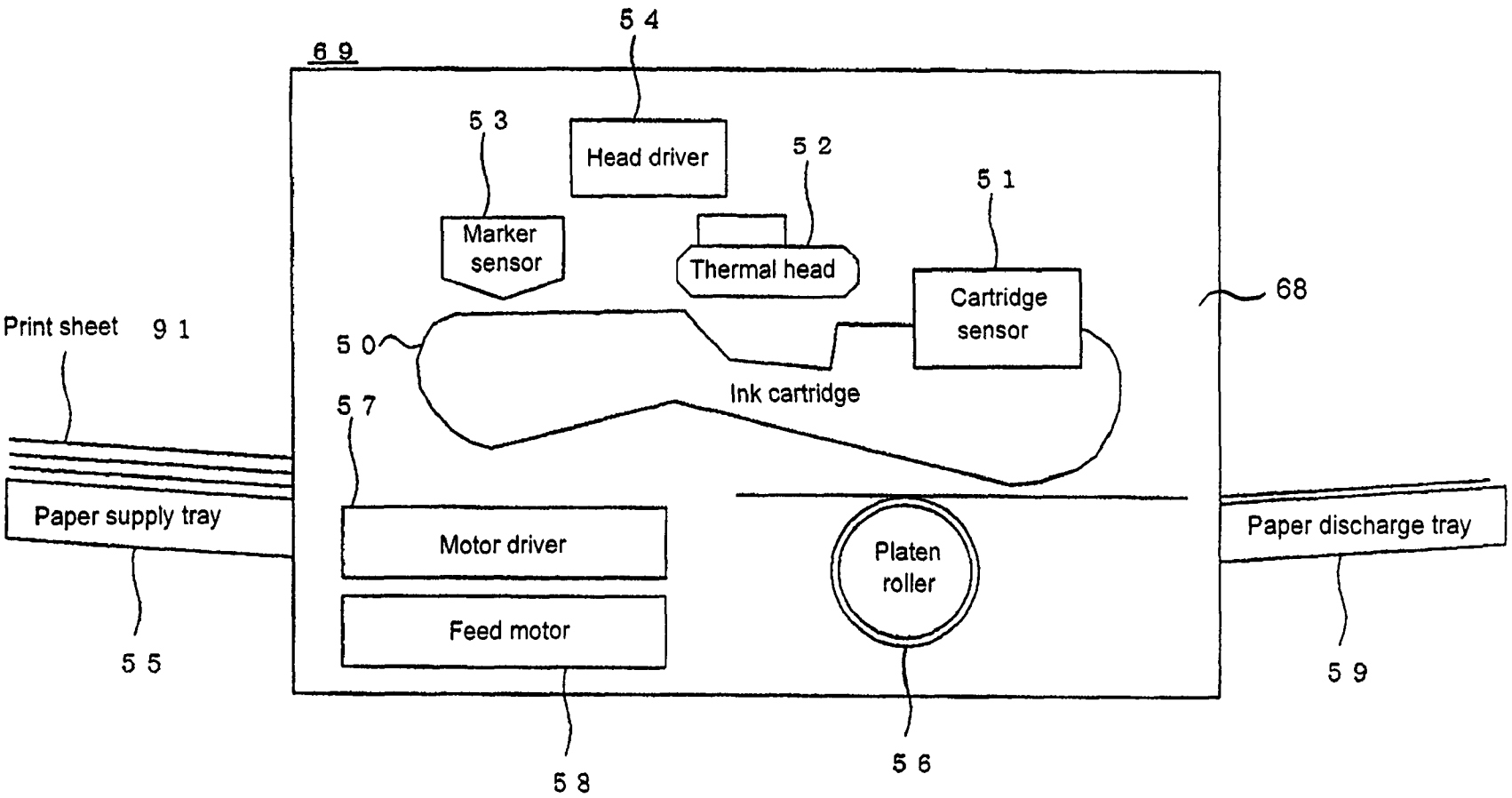
FIG. 2 is a schematic view of a thermal printer in accordance with the first embodiment of the present invention.

FIG. 2 is a schematic view of a thermal printer (image forming device) 69 that employs sublimation type thermal transfer.

As shown in FIG. 2, a thermal printer 69 in accordance with the present invention includes the following components among others: a main body 68, a cartridge sensor (mounting state detecting unit) 51, a thermal head (thermal transfer mechanism unit) 52, a marker sensor (boundary line detecting unit) 53, a head driver 54, a paper supply tray 55, a platen roller (feed unit) 56, a motor driver 57, a feed motor (drive unit) 58, and a paper discharge tray 59. An ink ribbon cartridge 50 is detachably installed within the main body 68 of the thermal printer 69.

Figure 3:
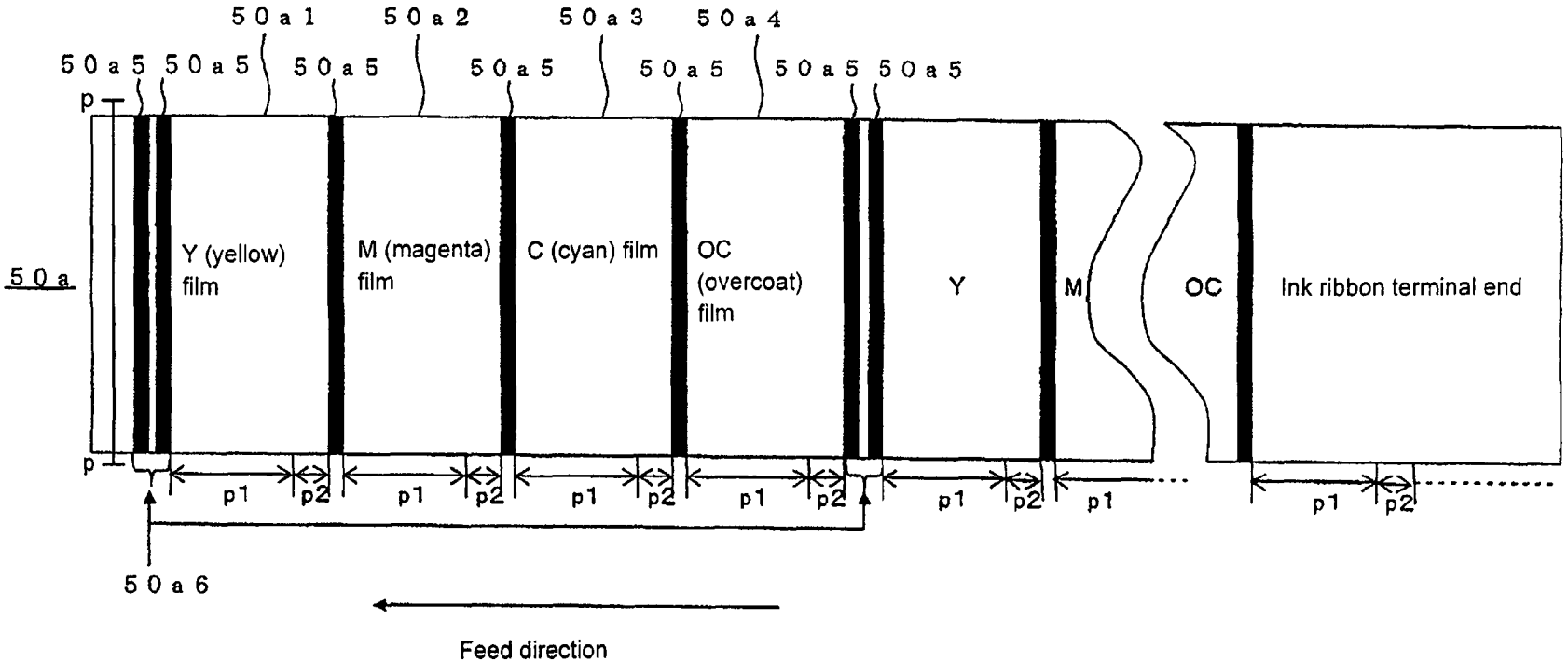
FIG. 3 is a schematic view of an ink ribbon in accordance with the first embodiment of the present invention.

The ink ribbon cartridge 50 houses an ink ribbon 50*a* like the one shown in FIG. 3. The ink ribbon will be described in detail later.

The cartridge sensor 51 is configured to detect an ink ribbon cartridge 50 that is installed, and also to identify the type ink ribbon cartridge 50 that is installed.

The thermal head (line head) 52 has heating elements (not shown) that are arranged in a row. The thermal energy of the heating elements heats the ink films (discussed later) of the ink ribbon 50*a* and transfers (sublimation type thermal transfer) the ink and the overcoat to a print sheet 91.

The marker sensor 53 is configured to scan the ink ribbon 50*a* when the ink ribbon 50*a* is fed, and to detect a black marker 50*a*5 provided on the ink ribbon 50*a* that reaches a predetermined position (for example, the position P-P shown in FIG. 3).

The head driver 54 has incorporated therein an OS (operating system) for driving the thermal head 52.

The paper supply tray 55 serves to hold print sheets 91 that will be used for printing.

The platen roller 56 serves to feed a print sheet 91 until the print sheet 91 reaches the ink ribbon cartridge 50. The platen roller 56 is driven by the feed motor (stepping motor) 58.

A thermal printer 69 in accordance with the present invention is configured to repeatedly transfer ink of a plurality of colors to the print sheet 91 and apply an overcoat comprising an OC (overcoat) film. The platen roller 56 and the feed motor 58 are configured such that they can rotate both forward and backward.

The motor driver 57 incorporates an operating system for driving the feed motor 58.

The discharge tray 59 serves to hold print sheets 91 that have been discharged to outside of the thermal printer 69.

<1-1. Overview of the Constituent Features of the Ink Ribbon 50*a*>

FIG. 3 is a schematic view showing the constituent features of an ink ribbon 50*a* in accordance with the first embodiment of the present invention. The ink ribbon 50*a* has ink films, which in this embodiment include yellow ink films (Y films) 50*a*1, magenta ink films (M films) 50*a*2, cyan ink films (C films) 50*a*3, and protective overcoat films (OC films) 50*a*4, and black markers 50*a*5 that indicate the boundaries between the ink films. The ink films 50*a*1, 50*a*2, 50*a*3, 50*a*4 and black markers 50*a*5 are formed on an ink ribbon sheet.

As indicated as the double marker 50*a*6 in FIG. 3, two black markers 50*a*5 are formed with a small predetermined gap p3 therebetween on the front side of each Y film 50*a*1 (left side of the Y film 50*a*1 in FIG. 3). Since the print processing is executed in the order of the Y film 50*a*1, the M film 50*a*2, the C film 50*a*3, and the OC film 50*a*4, the double marker 50*a*6 at the front side of the Y film 50*a*1 serves to indicate the lead position (print start position) for one print sheet 91's worth of print processing.

During the print processing (printing), the ink ribbon 50*a* is fed in the forward direction (leftward in FIG. 3) by a prescribed step distance (e.g., the distance p1 shown in FIG. 3) while each film is heated by the thermal head 52, causing the ink of each film to be thermally transferred to the print sheet 91.

After the thermal transfer printing is finished, the ink ribbon 50*a* is conveyed by the feed motor 58 until the next black marker 50*a*5 is detected by the marker sensor 53. In other words, a margin portion of each film (e.g., the portion p2) remains unused in the thermal transfer printing process.

As the ink ribbon 50*a* of the ink ribbon cartridge 50 is conveyed, if the next black marker 50*a*5) is detected before the ink ribbon 50*a* is conveyed for a prescribed step distance (e.g., the distance p2 shown in FIG. 3), it is determined that the current position is the start position of the next Y film, in other words the double marker 50*a*6 where two black markers 50*a*5 are provided. Conversely, if a black marker is not detected by the time the ink ribbon 50*a* has been conveyed by a prescribed distance (e.g., the distance p1+p2), it is determined that the current position is the terminal end of the ink ribbon cartridge 50*a*, and a terminal end processing (e.g., notifies the user that the ink ribbon is expended) is executed.

<1-2. Overview of the Constituent Features of the Cartridge Sensor>

Figures 4, 5:
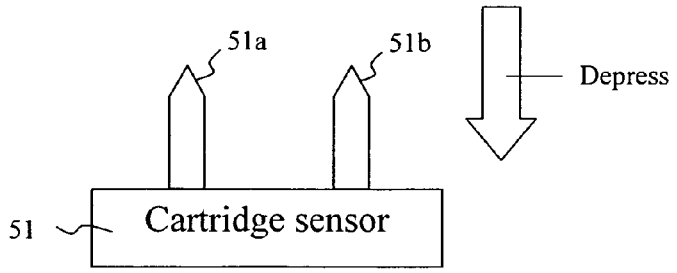
FIG. 4 is a schematic view of a cartridge sensor in accordance with the first embodiment of the present invention.
FIG. 5 is a table illustrating how the cartridge sensor in accordance with the first embodiment of the present invention determines the type of ink ribbon cartridge.

FIG. 4 is a schematic view of an example of a cartridge sensor 51 in accordance with the first embodiment of the present invention. The cartridge sensor 51 includes a switch 51*a* and a switch 51*b*. The switch 51*a* and the switch 51*b* are configured and arranged such that one or both of them are depressed in the downward direction indicated by the arrow in FIG. 4 when an ink ribbon cartridge 50 is installed. Each of the switches 51*a*, 51*b* is configured such that it is in an ON state when depressed and an OFF state when not depressed.

FIG. 5 illustrates an example of the relationships between the type of ink ribbon cartridge 50 installed and the ON/OFF states of the switches 51 *a*, 51*b*. For example, certain types of ink ribbon cartridges 50 might be provided with a different hole depending on the type of print sheet 91 they are intended to be used with. Depending on the hole, either the switch 51*a* or the switch 51*b* is not depressed when the ink ribbon cartridge 50 is installed, and thus remains OFF. The cartridge sensor 51 can determine the type of ink ribbon cartridge 50 based on which switch or switches 51*a*, 51*b* are ON or OFF.

For example, as shown in FIG. 5, when neither the switch 51*a* nor the switch 51*b* is depressed, the cartridge sensor 51 is configured to detect that an ink ribbon cartridge 50 is not installed.

Similarly, when the switch 51*a* is depressed and the switch 51*b* is not depressed, the cartridge sensor 51 is configured to detect that an ink ribbon cartridge 50 for use with card size print sheets is installed.

Furthermore, when the cartridge ribbon sensor 51 detects that an ink ribbon cartridge 50 has been installed, the cartridge ribbon sensor 51 is also configured to send a notification to the control unit indicating that an ink ribbon cartridge 50 has been installed, also indicating the type of ink ribbon cartridge 50 as determined based on the statuses of the switches 51*a*, 51*b* as described above.

<2. Descriptions of Key Components of the Electric Circuit System of the Thermal Printer>

The key components of the electric circuit system of the thermal printer 69 will now be described with reference to the block diagram shown in FIG. 6.

Figure 6:
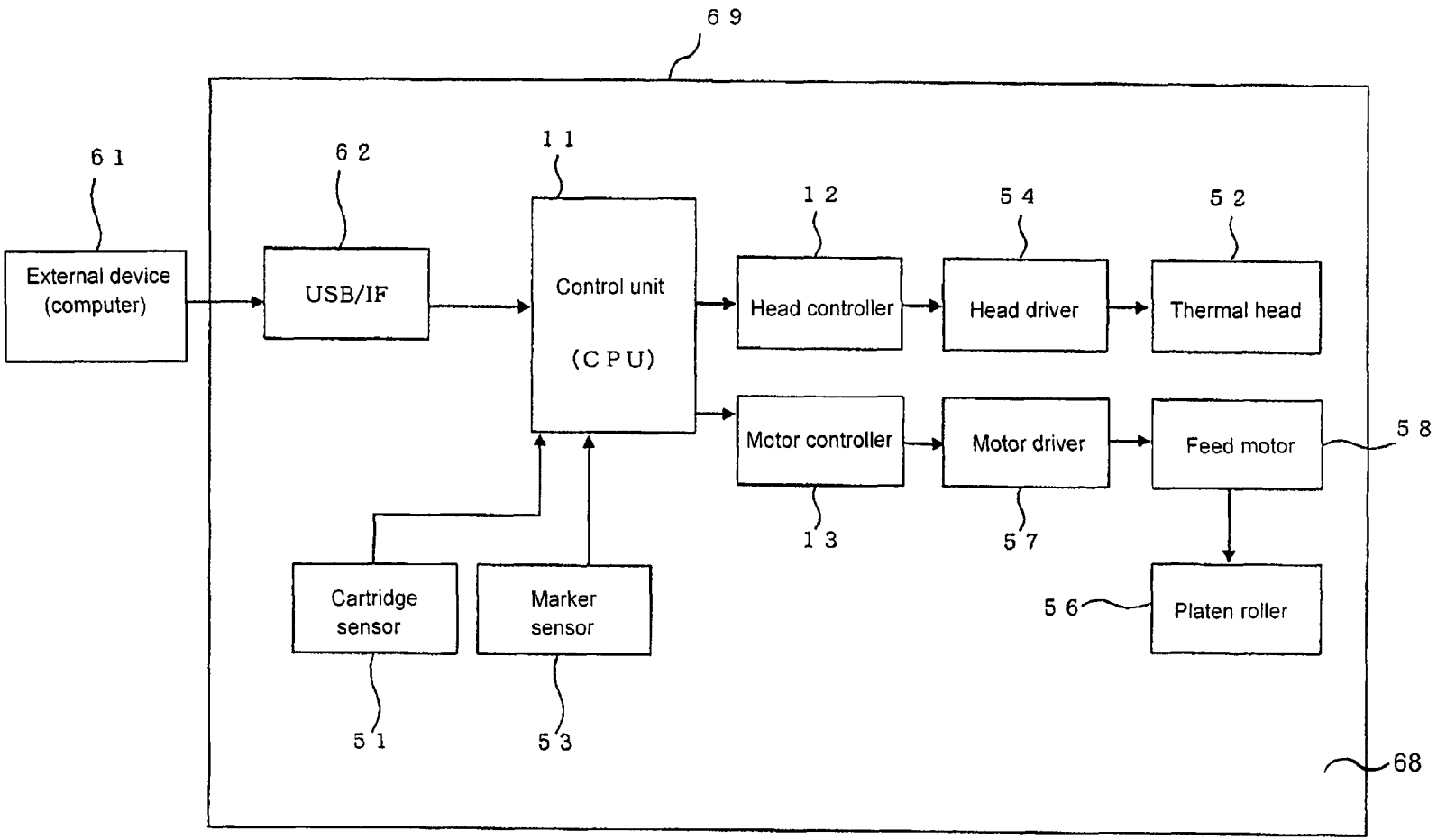
FIG. 6 is a block diagram of the key components of the electric circuit system of a thermal printer in accordance with the first embodiment of the present invention.

As shown in the block diagram of FIG. 6, a thermal printer 69 in accordance with the present invention includes the following components among others: a control unit (CPU) 11, a head controller 12, a motor controller 13, cartridge sensor 51, a thermal head 52, a marker sensor 53, a head driver 54, a platen roller 56, a motor driver 57, a feed motor 58, and a USB/IF (universal serial bus interface) 62.

The CPU 11 is a central component that is operatively connected to various components (e.g., the head controller 12) so as to selectively control these components and calculate and process data. The CPU 11 can include conventional components such as ROM (Read Only Memory) device and a RAM (Random Access Memory), and systematically controls the driving of the members of the thermal printer 69 and centrally controls the image formation processing.

The cartridge sensor 51 is configured to detect an ink ribbon cartridge 50 that is installed and determines the type of ink ribbon cartridge 50 that is installed with the switches 51*a*, 51*b*. The cartridge sensor 51 notifies the CPU 11 of the type of ink ribbon cartridge 50 it detects.

The marker sensor 53 is configured to scan the surface of the ink ribbon 50*a* (see FIG. 3) as the ink ribbon 50*a* is conveyed during the print processing, and to inform the CPU 11 when a black marker 50*a*5 is detected. In other words, the marker sensor 53 determines if a black marker 50*a*5 of the ink ribbon 50*a* has been conveyed to the position of the marker sensor 53.

The head controller 12 is configured to temporarily store a head control signal (H) sent from the CPU 11 in a buffer (not shown in the figures) and then transfer the signal to the head driver 54.

The head driver 54 is configured to send a drive command to the thermal head 52 when the head driver 54 receives a head control signal (H) from the head controller 12.

The thermal head 52 is configured to heat the films (see FIG. 3) and thermally transfer the ink and overcoat to the print sheet 91 (not shown in the figures) when the thermal head 52 receives the head control signal (H) from the head driver 54.

The motor controller 13 is configured to generate a motor control signal (M) and send the motor control signal (M) to the motor driver 57 when the motor controller 13 receives an instruction from the CPU 11.

The motor driver 57 is configured to send a drive command to the feed motor 58 when the motor driver 57 receives the motor control signal (M) from the motor controller 13.

The platen controller 56 is configured to feed the print sheet 91 and is driven by the feed motor 58.

The USB/IF 62 is an example of the input/output unit that is configured to enable the thermal printer 69 to receive print command signals and image data from an external device 61 (e.g., a computer or digital camera).

<3. Description of Printing Process of Thermal Printer>

The image forming process of a thermal printer 69 in accordance with the present invention will now be described with reference to the flowchart of FIG. 1, the schematic view of FIG. 3, and the block diagram of FIG. 6.

Figure 1:
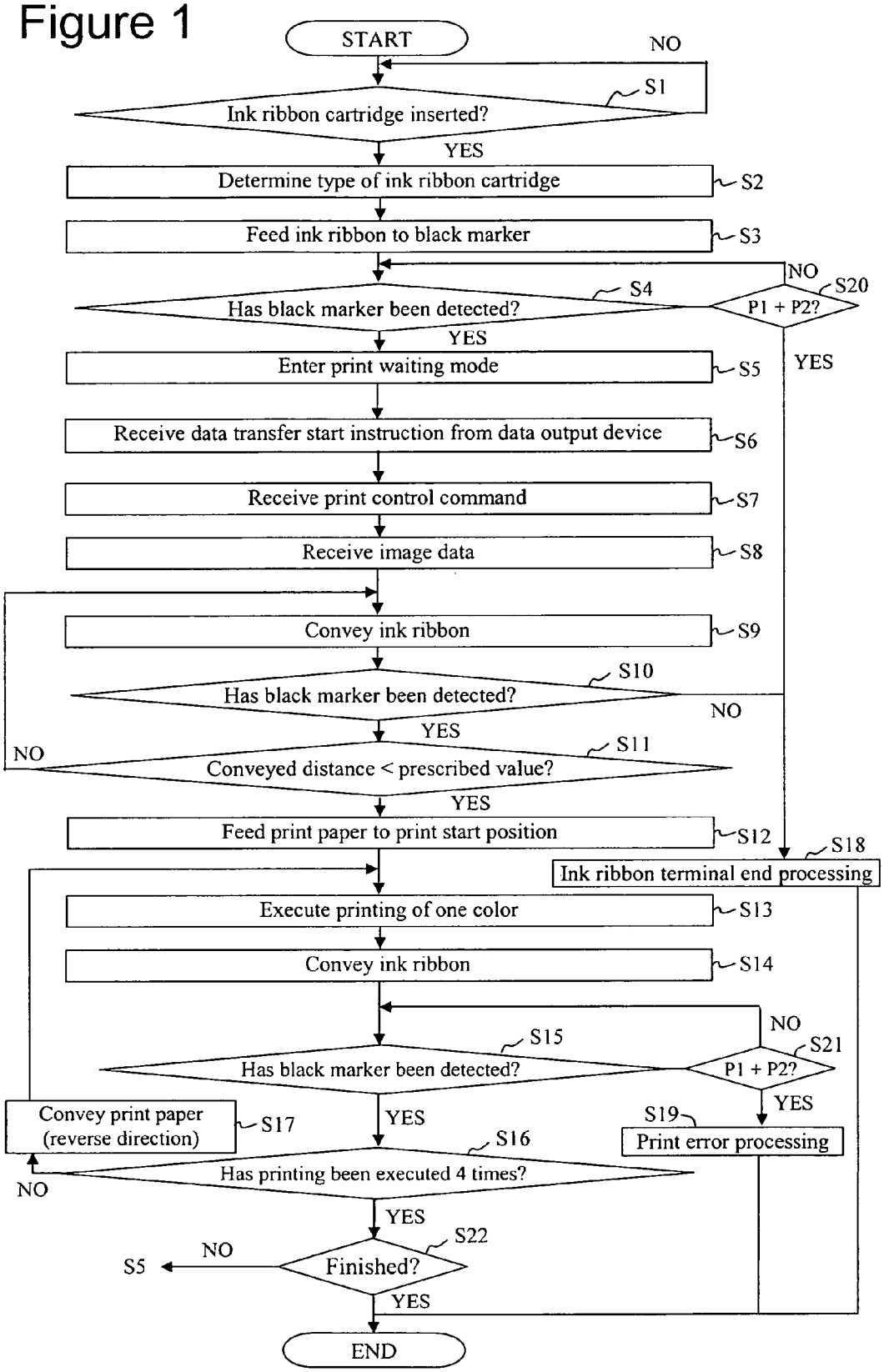
FIG. 1 is a processing flowchart in accordance with a first embodiment of the present invention.

As shown in FIG. 1, when a user installs an ink ribbon cartridge 50 into the thermal printer 69, the cartridge sensor 51 detects the installation and notifies the control unit (CPU) 11 (step S1). The thermal printer 69 may also be configured such that the same detection processing and notification processing is executed when the power to the thermal printer 69 is turned on while an ink ribbon cartridge 50 is already installed in the thermal printer 69. The image forming process shown in FIG. 1 starts when power to the thermal printer 69 is turned ON.

The cartridge sensor 51 also determines the type of ink ribbon cartridge 50 installed using the switches 51*a* and 51*b* and notifies the CPU 11 (step S2).

The CPU 11 receives the notification from the cartridge sensor 51 and sends a command to the motor controller 13 so as to drive the feed motor 58 through the motor driver 57. As a result, the feed motor 58 rotates the platen roller 56, winds the ink ribbon cartridge 50, and conveys the ink ribbon 50*a* inside the ink ribbon cartridge 50 in a prescribed direction (leftward in FIG. 3) (step S3).

While the ink ribbon 50*a* is being conveyed, the marker sensor 53 scans the surface of the ink ribbon 50*a* to detect a black marker 50*a*5. If the marker sensor 53 detects a black marker 50*a*5, the marker sensor 53 notifies the CPU 11 that a black marker 50*a*5 has been detected (step S4).

If a black marker 50*a*5 is not detected by the time the ink ribbon 50*a* has been conveyed a prescribed distance (e.g., the distance p1+p2 shown in FIG. 3), the CPU 11 determines that the ink ribbon 50*a* has been fed to the terminal end thereof and executes ink ribbon terminal end processing (in this embodiment, the control unit 11 issues an error notification to the user) (step S18).

If a black marker 50*a*5 is detected in step S4, the CPU 11 sends a command to the motor controller 13 so as to stop the conveyance of the ink ribbon 50*a* and shifts the thermal printer 69 into a print instruction waiting mode (step S5). The print instruction waiting mode continues until, for example, a print instruction is received from a user.

If the USB/IF 62 receives a print data transfer start instruction from an external device 61 (e.g., a computer), the USB/IF 62 notifies the CPU 11 that a print data transfer start instruction has been received (step S6).

The CPU 11 communicates with the external device 61 via the USB/IF 62 and receives print control commands and print image data from the external device 61 (steps S7, S8).

The CPU 11 commands the motor controller 13 to convey the ink ribbon 50*a*. Upon receiving the command, the motor controller 13 sends an instruction to the motor driver 57, thereby driving the feed motor 58 and conveying the ink ribbon 50*a* (step S9).

While the ink ribbon 50*a* is being conveyed, the marker sensor 53 scans the surface of the ink ribbon 50*a* and detects a black marker 50*a*5. When the marker sensor 53 detects a black marker 50*a*5, the marker sensor 53 notifies the CPU 11 that it has detected a black marker 50*a*5 (step S10).

In step S10, if a black marker 50*a*5 is not detected by the time the ink ribbon 50*a* is conveyed by the predetermined distance p3, the CPU 11 executes ink ribbon terminal end processing (step S18).

Meanwhile, if, in step S10, a black marker 50*a*5 is detected before the ink ribbon 50*a* is conveyed by the predetermined distance p3, the CPU 11 calculates the length over which the ink ribbon 50*a* was conveyed between the time when the previous black marker was detected and the time the current black marker was detected (step S11).

If the calculated length is shorter than a prescribed threshold value (e.g., the length p2 shown in FIG. 3), the CPU 11 determines that the ink ribbon 50*a* has been conveyed to the lead position of a Y film (i.e., a double marker 50*a*6 in FIG. 3 where the black markers 50*a*5 are provided with the predetermined gap p3 therebetween) and proceeds to the next step. If the calculated length is greater than the prescribed threshold value (e.g., the length p2 shown in FIG. 3), the CPU 11 returns to step S9 (step S11), and repeats the steps S9-S11 until the ink ribbon 50*a* is conveyed to the lead position.

The CPU 11 commands the motor controller 13 to feed a print sheet 91. Upon receiving the command, the motor controller 13 sends an instruction to the motor driver 57, thereby driving the feed motor 58 and rotating the platen roller 56. As a result, the print sheet 91 is conveyed to the print start position (step S12).

Once the print sheet 91 is conveyed to the print start position, the CPU 11 sends commands to the head controller 12 and the motor controller 13 so as to perform one color's worth (e.g., yellow) of thermal transfer processing by driving the thermal head 52 and the platen roller 56 (step S13).

For example, in executing the thermal transfer processing with Y (yellow) ink, the ink ribbon 50*a* is conveyed by a prescribed distance (e.g., the length p1) while simultaneously feeding the print sheet 91 with the platen roller 56. At the same time, the Y film 50*a*1 is heated by the thermal head 52, such that the ink of the Y film 50*a*1 is thermally transferred to the print sheet 91.

After the thermal transfer printing of Y ink is completed, the CPU 11 sends a command to the motor controller 13 and conveys the ink ribbon 50*a* up to the next black marker 50*a*5 (e.g., the lead position of the M film), using the marker sensor 53 and the feed motor 58. In the example shown in FIG. 3, the ink ribbon 50*a* is conveyed by the width p2 (step S14).

In step S14, if a black marker 50*a*5 is not detected by the marker sensor 53 by the time the ink ribbon 50*a* is conveyed by a prescribed distance (e.g., p1+p2), the CPU 11 determines that a print error has occurred (step S15). When a print error occurs, the CPU 11 executes a print error processing (e.g., notifying the user of the error and discharging the print sheet 91) (step S19).

Conversely, if, in step S15, a black marker 50*a*5 is detected by the marker sensor 53 before the ink ribbon 50*a* is conveyed by the prescribed distance (e.g., p1+p2), the CPU 11 sends a feed stop instruction to the motor controller 13. Then, the CPU 11 calculates the number of times the thermal transfer processing (step S13) has been executed since the print instruction was received from the external device 61 in step S6 (step S16).

If the calculated value is 4 in step S16, the CPU 11 ends the current print processing, and enters the waiting mode of step S5, unless the user indicates that the printing processing is finished (step S22). If the calculated value is less than 4, the CPU 11 sends a command to the motor controller 13 instructing the motor controller 13 to drive the platen roller 56 in the reverse direction, which is opposite the direction it rotates during the printing (step S17). Accordingly, the print sheet 91 is reverse-conveyed to the print start position, and the CPU 11 returns to step S13.

By repeating the steps S13 through S17, thermal transfer of three colors (e.g., yellow, magenta, and cyan) of ink film and an OC film is performed and the print sheet 91 is discharged by the platen roller 56, at which point the processing ends.

As described above, in this embodiment, the lead position alignment of the ink film 50*a* using the black markers 51*a*5 (i.e., the feeding of the ink ribbon 50*a* to the next print start position of the ink films) (steps S3 and S4) is performed before the print instruction is received, i.e. when an ink ribbon cartridge is installed or when the printer power is turned on. The error processing (step S18) that is required if a black marker 50*a*5 is not detected can also be performed before the print instruction is received.

As a result, the number of times that repetitive processes (steps S9 to S11) are to be repeated after the print instruction is received can be reduced, and the amount of time the user spends waiting for a printed output can be shortened.

Also, in this embodiment, since the lead position alignment of the ink films is executed before the print start instruction is received, it is possible to detect that the ink ribbon 50*a* has been exhausted and execute the ink ribbon terminal end processing before the print start instruction is received.

As a result, unlike in a conventional image forming device, the user can avoid having to wait for the image forming device to detect an error after the user sends printing data to the image forming device, or having to repeat certain procedures (such as sending the print start instruction again) after the error processing is completed.

Second Embodiment

Figure 7:
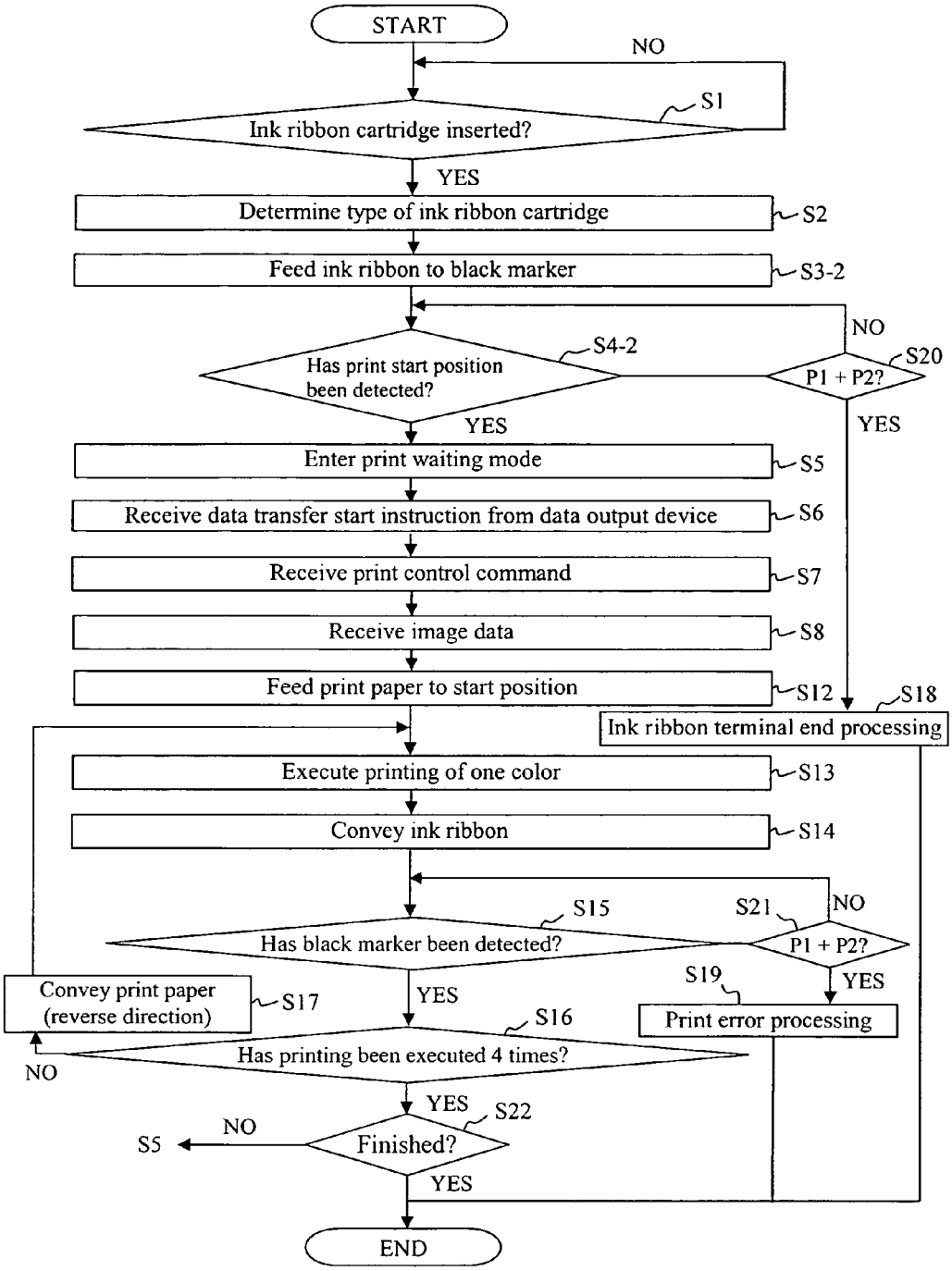
FIG. 7 is a processing flowchart in accordance with a second embodiment of the present invention.

Referring now to FIG. 7 an image forming method and an image forming device in accordance with another embodiments of the present invention will now be described. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity. The parts of the second embodiment that differ from the parts of the first embodiment will be indicated with a double prime (").

<1. Overview of the Constituent Features of the Thermal Printer>

Figure 8:
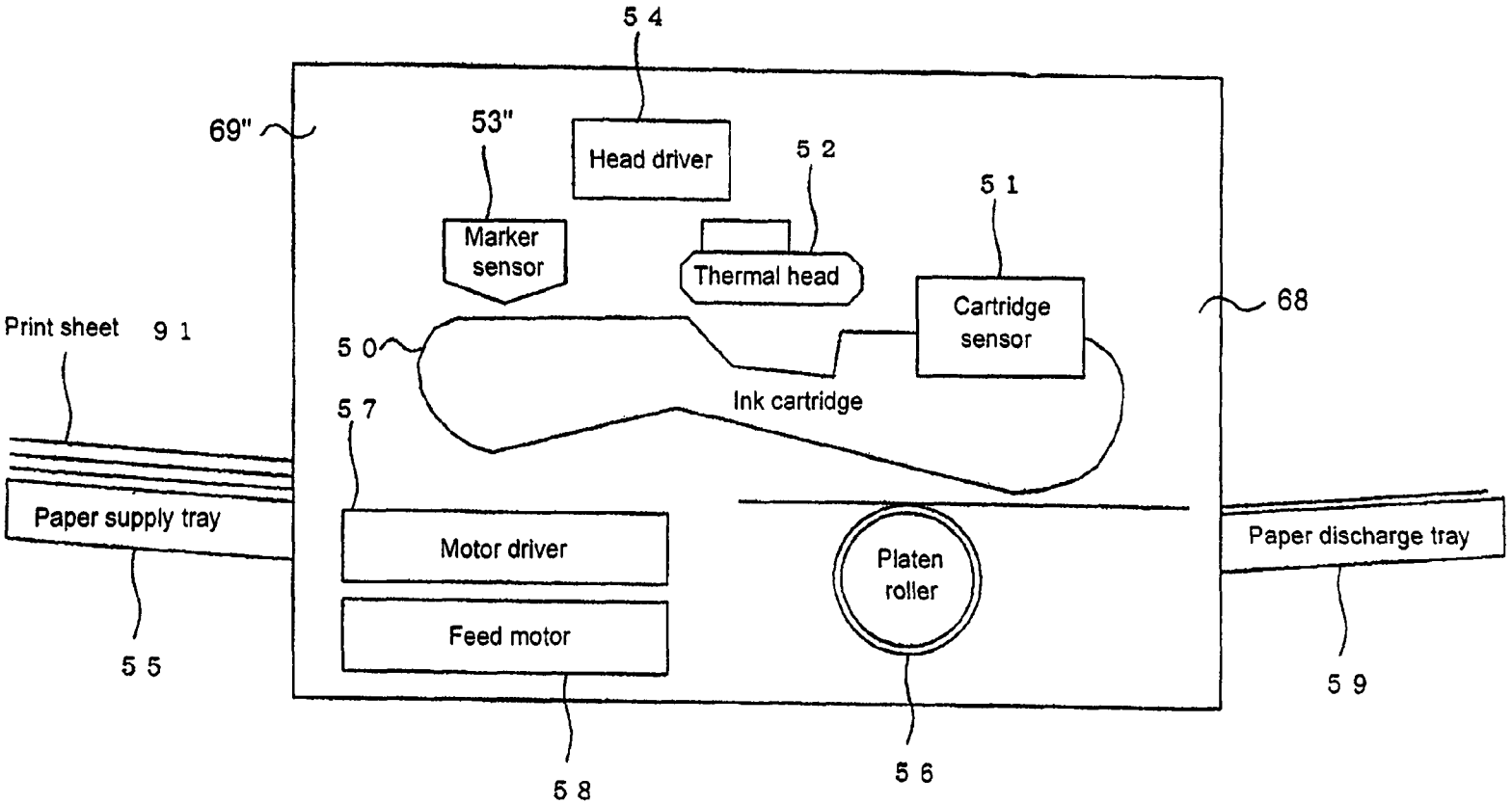
FIG. 8 is a schematic view of a thermal printer in accordance with the second embodiment of the present invention.

The thermal printer 69" of this embodiment is similar to the thermal printer 69 of the first embodiment except that the thermal printer 69" is provided with a marker sensor 53" (FIG. 8) having other functions in addition to those of the marker sensor 53. The additional functions of the marker sensor 53" are described below.

By providing the marker sensor 53" with a sensor function that can detect the number of black markers, a print start position 50*a*6 of the ink ribbon 50 (e.g., the lead position of a Y film 50*a*1) can be detected. An example of such function is disclosed in Japanese Patent No. 6-32976, to which U.S. Pat. No. 4,771,296 corresponds. Japanese patent No. 6-32976 and U.S. Pat. No. 4,771,296 are incorporated herein by reference. As a result, when an ink ribbon cartridge 50 is installed or when the power to the thermal printer 69" is turned on while an ink ribbon cartridge 50 is already installed, the CPU 11 can feed the ink ribbon 50*a* to the print start position 50*a*6 using the marker sensor 53" and the feed motor 58.

<1-1. Overview of the Constituent Features of the Ink Ribbon Cartridge>

Description of the constituent features of the ink ribbon cartridge 50 is omitted herein because the constituent features of the ink ribbon cartridge 50 of the second embodiment are the same as those of the first embodiment.

<1-2. Overview of the Constituent Features of the Cartridge Sensor>

Description of the constituent features of the cartridge sensor 51 is omitted herein because the constituent features of the cartridge sensor 51 of the second embodiment are the same as those of the first embodiment.

<2. Descriptions of Key Components of the Electric Circuit System of the Thermal Printer>

Description of the components of the electric circuit system of the thermal printer 69" is omitted herein because the components of the electric circuit system of the thermal printer 69" of the second embodiment are the same as those of the first embodiment.

<3. Description of Printing Process of Thermal Printer>

The print process of a thermal printer 69" in accordance with the second embodiment of the present invention will now be described with reference to the flowchart of FIG. 7, the schematic view of FIG. 3, and the block diagram of FIG. 6. Descriptions of processing steps that are the same as in the first embodiment are omitted for the sake of brevity.

FIG. 7 is a flowchart of the processing steps executed by the thermal printer 69" in accordance with the present invention that is a sublimation type thermal transfer. This flowchart is different from the flowchart of the first embodiment show in FIG. 1 in that step S3 of FIG. 1 is replaced with step S3-2 and step S4 of FIG. 1 is replaced with step S4-2. Also, the steps S9 to S11 of FIG. 1 are eliminated because they are not necessary.

In this second embodiment as shown in FIG. 7, after executing steps S1 and S2, the CPU 11 sends a command to the motor controller 13 and drives the feed motor 58 through the motor driver 57. As a result, the ink ribbon cartridge 50 is wound and ink ribbon 50*a* inside the ink ribbon cartridge 50 is conveyed in a prescribed direction (leftward in FIG. 3).

While the ink ribbon 50*a* is being conveyed, the marker sensor 53" scans the surface of the ink ribbon 50*a* and attempts to detect a print start position 50*a*6 (e.g., a place where two black markers 50*a*5 are provided close together with a predetermined gap p3 therebetween). (Step S3-2) Unlike the marker sensor 53 of the first embodiment, the marker sensor 53" of the second embodiment is capable of detecting the print start position 50*a*6 by detecting the number of black markers 50*a*5.

If a print start position 50*a*6 is not detected by the marker sensor 53" by the time the ink ribbon 50*a* is conveyed by a prescribed distance (e.g., the distance (p1+p2)×4 shown in FIG. 3), the CPU 11 determines that the ink ribbon 50*a* has been conveyed up to the terminal end thereof (step S4-2). In such a case, the CPU 11 proceeds to step S18 (where it executes ink ribbon terminal end processing).

If a print start position 50*a*6 is detected by the marker sensor 53" before the ink ribbon 50*a* has been conveyed the prescribed distance (e.g., the distance (p1+p2)×4), the marker sensor 53" notifies the CPU 11 that a print start position 50*a*6 has been detected.

Upon receiving the notification from the marker sensor 53", the CPU 11 controls the motor driver 57 so as to stop the feed motor 58 and thereby stop the conveyance of the ink ribbon 50*a*. The CPU 11 then proceeds to step S5.

Steps S5 to S8 of the second embodiment are the same as those of the first embodiment. Thus, explanations thereof are omitted for the sake of brevity.

Steps S9 to S11 of the first embodiment shown in FIG. 1 are not necessary in this second embodiment because the ink ribbon 50*a* is already conveyed up to the print start position 50*a*6 in step S3-2. Therefore, steps S9 to S11 are not shown in FIG. 7.

Steps S12 to S18 are the same as those of the first embodiment. Thus, explanations thereof are omitted for the sake of brevity.

As described above, in a thermal printer 69" in accordance with the second embodiment of the present invention, the process of feeding the ink ribbon 50*a* to a print start position 50*a*6 (step S3-2) and the process of detecting a print start position 50*a*6 (step S4-2) are executed when an ink ribbon cartridge 50 is installed or when the power to the thermal printer 69" is turned on while an ink ribbon cartridge is already installed, which is before a print instruction is received. Thus, if the ink ribbon 50*a* is exhausted to its terminal end, a print start position will not be detected and the thermal printer 69" can execute the ink ribbon terminal end processing (step S18) before the user sends a print start instruction. As a result, the ink ribbon lead position alignment (steps S9 to S11 in FIG. 1) that conventional printers execute after a print instruction is received can be omitted from the processing flow, and the amount of time the user needs to spend waiting for a print out can be shortened.

Also, with this thermal printer 69", the feed processing (step S3-2) and the print start position detecting processing (step S4-2) are executed before the user sends a print instruction. Thus, detection of the terminal end of the ink ribbon 50*a* and the associated error processing (step S18) can be executed before a print start instruction is received. As a result, unlike in a conventional image forming device, the user can avoid having to wait for the image forming device to detect an error after the user sends printing data to the image forming device, or having to repeat certain procedures (such as sending the print start instruction again) after the error processing is completed.

Other Embodiments

Although embodiments of the present invention are explained above, the present invention is not limited to these embodiments. Various modifications can be made within the scope of the present invention.

For example, it is also acceptable to supply to the thermal printer 69 a storage medium in which software program code that is configured to execute the functions of one of the above described embodiments is recorded. Then, as should be obvious, the computer (e.g., a CPU) inside the thermal printer 69 can read and execute the program code stored on the storage medium in order to execute the functions.

In such a case, the program code read from the storage medium is what effects the functions of the above described embodiment. In other words, the storage medium with the program code stored thereon allows an embodiment of the present invention to take place.

Examples of storage media for supplying the program code to the thermal printer 69 include floppy disks, hard disks, optical disks, magnetic optical disks, CD-ROM, CD-R, magnetic tape, non-volatile memory cards, etc.

Also, as should be obvious, the idea of executing the functions of the above described embodiments with program code that has been read by a computer encompasses an arrangement in which an operating system (OS) running on the computer executes a portion or all of the actual processing based on instructions contained in the program code such that the functions of the above described embodiments are achieved by executing such processing.

Furthermore, as should be obvious, this idea also encompasses an arrangement in which the program code read from the storage medium is written to a memory provided in a function expansion board inserted into the computer, or a memory provided in a function expansion unit connected to the computer. In this case, a CPU or the like provided in the function expansion board or function expansion unit executes a portion or all of the actual processing based on instructions contained in the program code such that the aforementioned functions of the embodiment are realized by executing the processing.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±15% of the modified term if this deviation would not negate the meaning of the word it modifies.

This application claims priority to Japanese Patent Application No. 2005-054068. The entire disclosure of Japanese Patent Application No. 2005-054068 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A method of forming an image on a transfer sheet based on electronic data using an image forming device and an ink ribbon cartridge, an ink ribbon of the ink ribbon cartridge having a plurality of ink films formed thereon with boundary lines being provided between the ink films, the method comprising:

turning on power to the image forming device;

installing the ink ribbon cartridge in the image forming device;

a user inputting an image forming instruction;

initially conveying the ink ribbon of the ink ribbon cartridge with the image forming device while determining with a boundary line detecting unit of the image forming device whether at least one of the boundary lines formed on the ink ribbon has reached a predetermined position in the image forming device, the initially conveying of the ink ribbon and the determining being commenced in response to power to the image forming device being turned on or in response to the ink ribbon cartridge being installed in the image forming device, and the initially conveying of the ink ribbon and the determining being commenced and completed before the user inputs the image forming instruction for a first time after the power to the image forming device has been turned on or the ink ribbon cartridge has been installed in the image forming device, the initially conveying of the ink ribbon being completed upon the boundary line detecting unit of the image forming device determining that the at least one of the boundary lines has reached the predetermined position in the image forming device such that the image forming device enters a print instruction waiting mode;

subsequently conveying the ink ribbon of the ink ribbon cartridge with the image forming device in response to receiving the image forming instruction while the image forming device is in the print instruction waiting mode;

calculating a conveyed length of the ink ribbon during the subsequently conveying of the ink ribbon upon the boundary line detecting unit of the image forming device determining that the at least one of the boundary lines has reached the predetermined position;

forming the image on the transfer sheet in response to the conveyed length of the ink ribbon being determined to be less than a prescribed threshold value that is less than a length of each of the ink films; and determining that the ink ribbon has been expended to its terminal end when the boundary line detecting unit of the image forming device determines that no boundary line has reached the predetermined position while the ink ribbon is conveyed by a prescribed distance that is equal to or greater than the length of each of the ink films.

2. The image forming method recited in claim 1, further comprising:

stopping the initially conveyance of the ink ribbon when it is determined that a boundary line has reached the predetermined position before the user inputs the image forming instruction.

3. The image forming method recited in claim 1, wherein:

some of the boundary lines formed on the ink ribbon constitute print start positions, during the initially conveying of the ink ribbon of the ink ribbon cartridge, it is determined with a print start position detecting unit whether a print start position formed on the ink ribbon has reached a predetermined position in the image forming device, the initially conveying of the ink ribbon and the determining being performed when the power to the image forming device is turned on and the ink ribbon cartridge is installed in the image forming device and before the user inputs the image forming instruction, and the image forming method further comprising stopping the initially conveyance of the ink ribbon when it is determined that a print start position has reached the predetermined position before the user inputs the image forming instruction;

determining that the ink ribbon has been expended to its terminal end when no print start position is determined to have reached the predetermined position by the time the ink ribbon is conveyed by the prescribed distance; and notifying a user that the ink ribbon is expended when it is determined that the ink ribbon has been expended to its terminal end.

4. A method of forming an image on a transfer sheet based on electronic data using an image forming device and an ink ribbon cartridge, an ink ribbon of the ink ribbon cartridge having a plurality of ink films formed thereon with boundary lines being provided between the ink films, the method comprising:

turning on power to the image forming device;

installing the ink ribbon cartridge in the image forming device;

a user inputting an image forming instruction;

initially conveying the ink ribbon of the ink ribbon cartridge while determining with a boundary line detecting unit of the image forming device whether at least one of the boundary lines formed on the ink ribbon has reached a predetermined position in the image forming device, the initially conveying of the ink ribbon and the determining being performed in response to power to the image forming device being turned on or in response to the ink ribbon cartridge being installed in the image forming device and before the user inputs the image forming instruction, the initially conveying of the ink ribbon being completed upon the boundary line detecting unit of the image forming device determining that the at least one of the boundary lines has reached the predetermined position in the image forming device such that the image forming device enters a print instruction waiting mode;

subsequently conveying the ink ribbon of the ink ribbon cartridge in response to receiving the image forming instruction while the image forming device is in the print instruction waiting mode;

calculating a conveyed length of the ink ribbon during the subsequently conveying of the ink ribbon upon the boundary line detecting unit of the image forming device determining that the at least one of the boundary lines has reached the predetermined position;

forming the image on the transfer sheet in response to the conveyed length of the ink ribbon being determined to be less than a prescribed threshold value that is less than a length of each of the ink films;

determining that the ink ribbon has been expended to its terminal end when the boundary line detecting unit of the image forming device determines that no boundary line has reached the predetermined position while the ink ribbon is conveyed by a prescribed distance that is equal to or greater than the length of each of the ink films; and notifying the user that the ink ribbon is expended, when it is determined that the ink ribbon has been expended to its terminal end.

5. A method of forming an image on a transfer sheet based on electronic data using an image forming device and an ink ribbon cartridge, an ink ribbon of the ink ribbon cartridge having a plurality of ink films of yellow, magenta, cyan, and overcoat formed thereon with black boundary lines being provided between the ink films, the method comprising:

turning on power to the image forming device;

installing the ink ribbon cartridge in the image forming device;

user inputting an image forming instruction;

initially conveying the ink ribbon of the ink ribbon cartridge while determining with a boundary line detecting unit of the image forming device whether at least one of the black boundary lines formed on the ink ribbon has reached a predetermined position in the image forming device, the initially conveying of the ink ribbon and the determining being performed in response to power to the image forming device being turned on or in response to the ink ribbon cartridge being installed in the image forming device and before the user inputs the image forming instruction;

stopping the initially conveying of the ink ribbon when it is determined that a black boundary line has reached the predetermined position before the user inputs the image forming instruction such that the image forming device enters a print instruction waiting mode;

subsequently conveying the ink ribbon of the ink ribbon cartridge in response to receiving the image forming instruction while the image forming device is in the print instruction waiting mode;

calculating a conveyed length of the ink ribbon during the subsequently conveying of the ink ribbon when it is determined that the black boundary line has reached the predetermined position;

forming the image on the transfer sheet in response to the conveyed length of the ink ribbon being determined to be less than a prescribed threshold value that is less than a length of each of the ink films;

determining that the ink ribbon has been expended to its terminal end when the boundary line detecting unit of the image forming device determines that no black boundary line has reached the predetermined position while the ink ribbon is conveyed by a prescribed distance that is equal to or greater than the length of each of the ink films; and notifying a user that the ink ribbon is expended when it is determined that the ink ribbon has been expended to its terminal end.

* * * * *